US006000815A

United States Patent [19]

Jennings

[11] Patent Number: 6,000,815

[45] Date of Patent: Dec. 14, 1999

[54] MECHANICALLY ALIGNED LAMP REFLECTOR ASSEMBLY

[76] Inventor: Steve Jennings, 2301 W. 205th St., Suite 103, Torrance, Calif. 90501

[21] Appl. No.: 09/055,634

[22] Filed: Apr. 6, 1998

[51] Int. Cl.[6] ..... F41J 9/13

[52] U.S. Cl. ..... 362/285; 362/322; 362/419; 362/263; 250/504 R; 250/503.2

[58] Field of Search ..... 362/285, 306, 362/296, 263, 322, 418, 419, 284, 324; 250/493.1, 504 R, 503.1

[56] References Cited

U.S. PATENT DOCUMENTS 5,050,044 9/1991 Shibayama ..... 362/18
5,387,800 2/1995 Kurtich et al. ..... 250/504 R

*Primary Examiner*—Thomas M. Sember

*Attorney, Agent, or Firm*—Cislo & Thomas, LLP

[57] ABSTRACT

A lamp reflector assembly includes a fixture having a base and a support member movably attached to the base. Attached to the support member is a pair of spaced-apart arms, each having an electrical receptacle. Connected to the electrical receptacles are electrical contacts of opposing ends of an elongate lamp, with a middle portion that emits radiation. Attached to the base of the fixture is a concave reflector having a pair of clearance holes sized to permit the end portions of the lamp to pass through, to locate the electrical contacts outside the reflector. The resulting combination provides adjustability of the position of the lamp relative the position of the reflector, to focus the radiation reflected generally forwardly from the reflector. The present invention offers important advantages over a prior art adjustable assembly, where the reflector is bonded to a sheet metal bracket.

17 Claims, 3 Drawing Sheets

MECHANICALLY ALIGNED LAMP REFLECTOR ASSEMBLY

FIELD OF THE INVENTION

The present invention relates generally to lamp reflector assemblies for ultraviolet curing of adhesives and other uses, and more particularly to such an assembly providing mechanical alignment between the relative positions of the lamp and reflector to focus the output of radiant energy from the reflector onto the workpiece.

BACKGROUND OF THE INVENTION

Lamp assemblies including a generally concave shaped reflector are well-known for use in curing photoinitiated adhesives and other coating compositions.

UV radiation curing offers significant energy and savings versus thermal curing in heat ovens. UV radiation curing also is much quicker offering significant time savings, and is more environmentally friendly in reducing toxic emissions. Another advantage of UV curing is the adhesives leave behind no solvent residue, as is common with thermoplastic adhesives which set upon cooling or evaporation of a solvent. This is important in certain applications, e.g. medical device manufacturing, to avoid compromising biomedical acceptability.

Previously, lamp assemblies commercially available for UV curing included a lamp horizontally disposed and fixed at the time of manufacture in a reflector. These lamp assemblies were criticized as inefficient. A "Prefocused Lamp Reflector Assembly" was proposed in U.S. Pat. No. 5,387,800 issued to Dymax Corporation, and a similar lamp assembly is currently being sold by Dymax. That assembly provides for moving of the reflector and thereby manually focusing the radiation from the lamp by the user. Then the relative position of the reflector to the lamp is fixed by the user through use of a bonding material.

Although the Dymax lamp assembly has proven generally suitable for its intended purposes, it possesses numerous inherent deficiencies which detract from its overall effectiveness and desirability. During the focusing process the user is exposed to the UV radiation from the lamp assembly, and possible electric shock from the connections of the power source to the lamp. Touching the lamp or reflector leaves behind human skin oil, which may later adversely affect performance of the lamp assembly or cause the lamp or reflector to crack at the place where human skin oil resides.

After the Dymax lamp assembly is focused, the reflector is bonded to a thin sheet metal bracket with clips holding the lamp. As the bonding material solidifies over several hours, sometimes the reflector skews slightly which reduces the output from the lamp assembly. Once the bonding material has solidified, it is no longer possible to refocus the lamp assembly. The bonding material may also deteriorate over time, causing further problems.

Because only weak structure secures the lamp, sometimes there is arcing between the lamp and the bracket contacts. Additionally, the weak structure of the Dymax lamp assembly provides little protection for the fragile lamp and reflector, which are subject to breakage especially during shipping.

In view of the shortcomings of the prior art, it is an object of this invention to provide a lamp reflector assembly providing speedy and easy alignment of the reflector relative to the lamp, to mechanically focus the radiation output of the assembly.

It is a further object of this invention to provide a lamp reflector assembly with sufficiently strong structural framework to maintain indefinitely the position of the reflector and the lamp once focusing by the user is complete, and to protect the lamp and reflector during shipping.

It is still a further object of this invention to provide a lamp reflector assembly such that focusing can be completed without unduly exposing the user to UV radiation or electric shock, and without the user having to touch the lamp or reflector thereby depositing human skin oil.

Finally, it is yet another object of the present invention to fix the relative position of the reflector to the lamp without the use of bonding material.

SUMMARY OF THE INVENTION

The present invention specifically alleviates the above-mentioned deficiencies associated with the prior art, and addresses the objects of the invention also mentioned above.

In a first embodiment of the invention, a lamp reflector assembly includes a fixture having a base and a support member movably attached to the base. Attached to the support member is a pair of spaced-apart arms, each having an electrical receptacle. An elongate lamp has opposite end portions with electrical contacts connected to the fixture's electrical receptacles, and has a middle portion which emits radiation. Finally, a concave reflector attached to the base has a pair of clearance holes sized to permit the end portions of the lamp to pass therethrough, to position the electrical contacts of the lamp outside the reflector. The position of the lamp is adjustable relative to the position of the reflector, to focus the radiation reflected generally forwardly from the reflector.

In the preferred embodiment the movable support member of the fixture is made of an insulating material, so as not to conduct electricity from the lamp or its power source and reduce the risk of electric shock to the user. The fixture support member and arms are of substantial thickness and nondeformable, such that once the lamp and reflector are aligned that alignment is maintainable. The reflector is preferably attached to the base at a forward end of the reflector concave surface. No bonding material is used.

In use, the lamp is aligned inside the reflector to focus the output of radiant energy, and that alignment is maintained by the substantial structure of the fixture. The reflector is attached to the base of the fixture, and the middle portion of the lamp is positioned inside the reflector. In the focusing operation, the user need not touch the reflector or lamp. The end portions of the lamp are attached to the fixture arms outside the reflector. The arms of the fixture are moveable to focus the output of radiant energy from the reflector. The substantial fixture structure surrounding the lamp and reflector helps prevent breakage of those fragile components.

These, as well as other advantages of the present invention will become more apparent from the following description and drawings. It is understood that changes in the specific structure shown and described may be made within the scope of the claims which follow without departing from the spirit of the invention.

DETAILED DESCRIPTION OF THE INVENTION

The detailed description set forth below in connection with the appended drawings is intended as a description of the presently preferred embodiment of the invention, and is not intended to represent the only form in which the present invention may be constructed or utilized. The description sets forth the functions and the sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

The mechanically aligned lamp reflector assembly of the present invention is illustrated in FIGS. 1 through 4 which depict a presently preferred embodiment of the invention.

Figure 2:
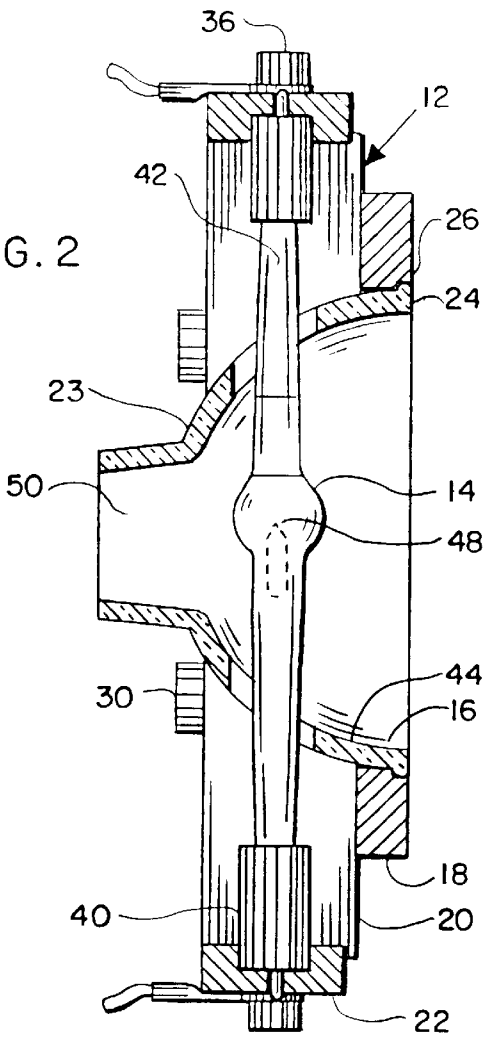
FIG. 2 is a side sectional view illustrating the same mechanically aligned lamp reflector assembly.
Figure 1:
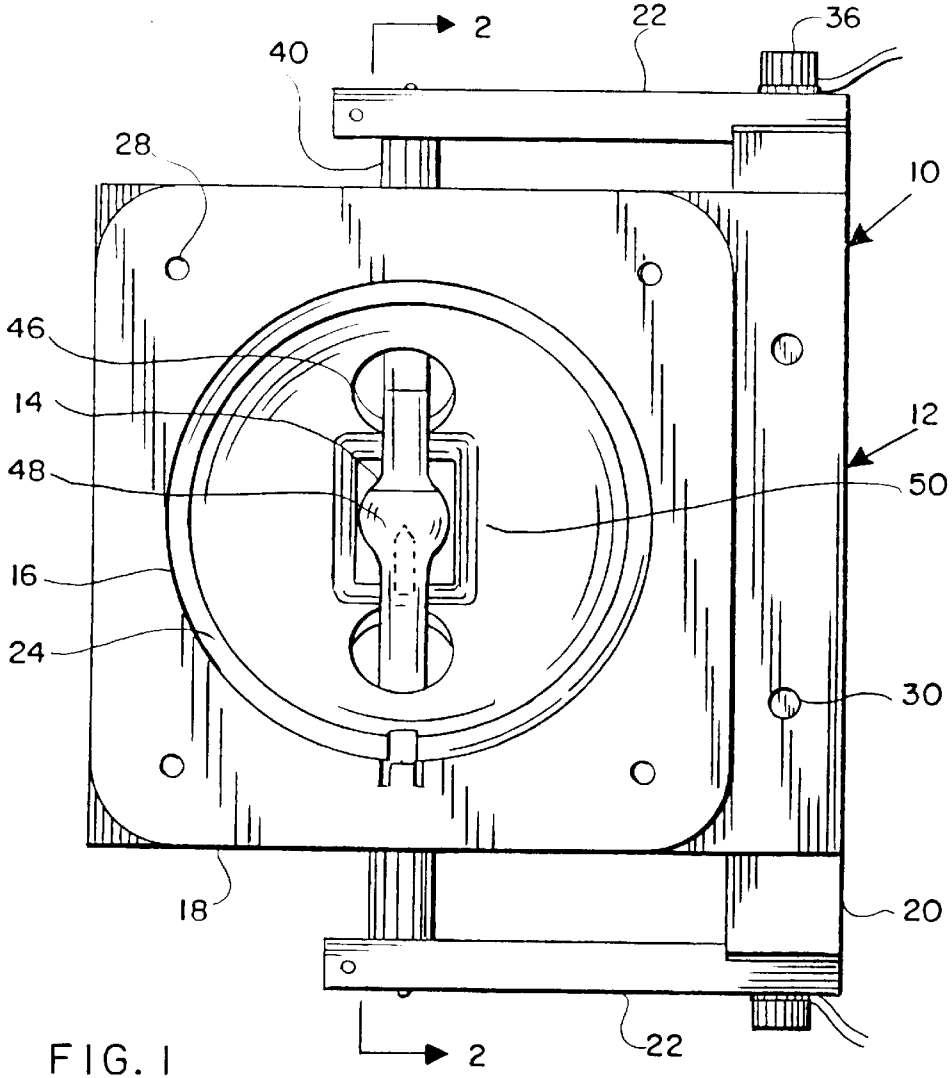
FIG. 1 is a front view illustrating an exemplary mechanically aligned lamp reflector assembly in accordance with the present invention.
Figure 3:
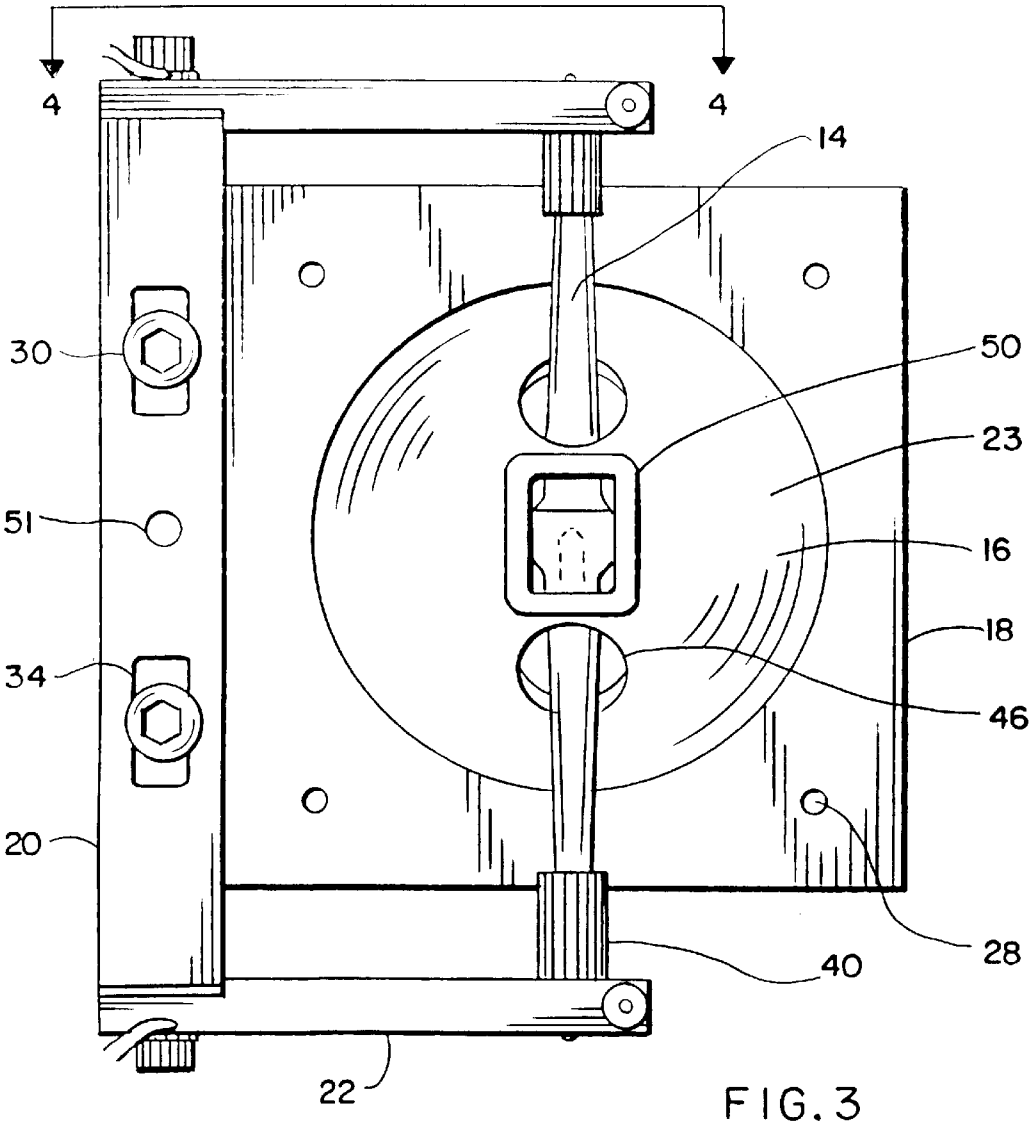
FIG. 3 is a rear view again illustrating the same mechanically aligned lamp reflector assembly.

Referring now to FIGS. 1 through 3, the lamp reflector assembly 10 is comprised generally of a fixture 12, an elongate lamp 14 and a parabolic reflector 16. The fixture 12 includes a base 18, a support member 20 and a pair of arms 22. The support member 20 and arms 22 are movable relative the base 18, such that the elongate lamp 14 is movable relative the parabolic reflector 16, thereby focusing the radiant energy from the reflector 16.

Continuing to refer to FIGS. 1 through 3, the fixture 12 may be described in more detail. The base 18 is a flat plate with a circular opening sized to receive the outer convex surface 23 of the reflector 16, but not large enough to allow an outer lip 24 of the reflector to pass through. The outer lip 24 is seated in an annular groove 26 surrounding the large circular opening in the base 18. The base 18 is preferably fabricated of aluminum or some other lightweight metal material having a substantial thickness of about 5/32". The base 18 is attachable through four mounting holes 28 to a framework (not shown) around a workstation for UV curing of adhesives, e.g. in medical device manufacturing.

Movably attached to the base 18 is a support member 20 in the shape of a rectangular block. The support member 20 is preferably made of Delrin®, a plastic material, or some other insulating material so as not to conduct electricity. The attachment of the support member 20 to the base 18 is preferably accomplished by a pair of screws 30. The support member 20 may include a pair of clearance holes 34, such that the support member 20 is free to slide in the same plane as the base 18 prior to tightening of screws 30.

Movably attached to the opposing ends of the support member 20 are a pair of arms 22 fabricated of brass or some other highly conductive material. The arms 22 are also of substantial thickness, approximately 3/8". Each of the arms 22 are attached to the support member 20 by a screw 36 which also electrically connects the arm 22 to a power supply (not shown). The opposing end of each arms 22 is slotted and includes a cavity, which forms a receptacle sized to receive the electrical contacts 40 on opposing ends 42 of the conventional elongate lamp 14.

As best shown in FIG. 2, the conventional reflector 16 is of a circular cross section having an inner concave surface 44 with a reflective coating. The reflector 16 includes a pair of aligned clearance holes 46, sized such that the opposing end portion 42 and bulb portion 48 of the conventional elongate lamp 14 are able to pass through the reflector 16. This places the lamp portion 14 inside the concave surface 44, and the electrical contacts outside the reflector 16. Radiant energy is emitted from the bulb 48, some of which travels in a forwardly direction perpendicular to the base 18, and some of which travels in another direction and is reflected off the inner surface 44 of the reflector 16 also to travel in a forwardly direction.

As best shown in FIG. 3, the rear of the conventional reflector 16 includes a rectangular cavity 50. This rear cavity 50 was previously used in the prior art to mount a bulb extending horizontally inside the reflector 16. Here it serves no particular function, although the user is able to look from behind the reflector and align the lamp such that the bulb portion 48 is centered inside the concave surface 44 of the reflector 16.

Having described the structure of the mechanically aligned lamp reflector assembly 10, it is now possible to describe its operation, function and use. To assemble the unit, the support member 20 and base 18 of the fixture 12 are secured together by a pair of screws 30. The reflector 16 is placed inside the large circular opening in the base 18, and the elongate lamp 14 bulb portion 48 is positioned inside the reflector. The lamp 14 opposing end portions 42 outside the reflector 16 are placed between the pair of fixture 12 arms 22, and the arms 22 are secured to the support member 20 with a pair of screws 36. Electric wires from a power source (not shown) are also electrically connected to the arms 22 by the screws 36. The base 18 of the fixture 12 is then secured to a frame structure (not shown) in a UV wiring workstation, through use of four mounting fasteners (not shown).

It is now possible to adjust the position of the lamp 14 relative the reflector 16, to increase the output of radiant energy from the unit. If it is desirable to move the lamp 14 in a plane parallel to the plane of the base 18, the screws 30 are loosened. Then a pin (not shown) is inserted into the center 51 in the support member 20, and it is possible to move the support member 20 as permitted by displacement of the screws 30 inside the clearance holes 34. Upon repositioning the lamp 14 inside the reflector 16, the screws 30 are tightened and the pin (not shown) removed from the center 51 of the support member 20.

Figure 4:
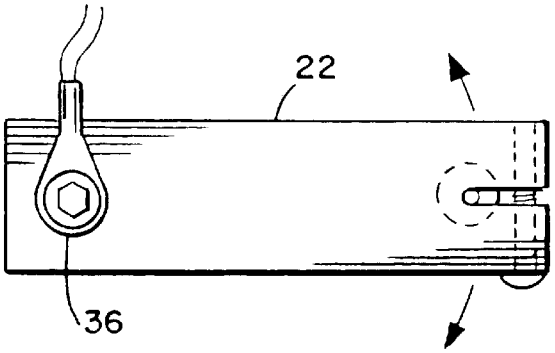
FIG. 4 is a partial top view illustrating a portion of the same assembly.

If it is desirable to move the lamp 14 forwardly or rearwardly, in a direction approximately perpendicular to the base 18, the screws 36 are loosened. The support arms 22 are rotatable, as shown in FIG. 4. Upon repositioning the lamp 14, the screws 36 are tightened.

Figure 5:
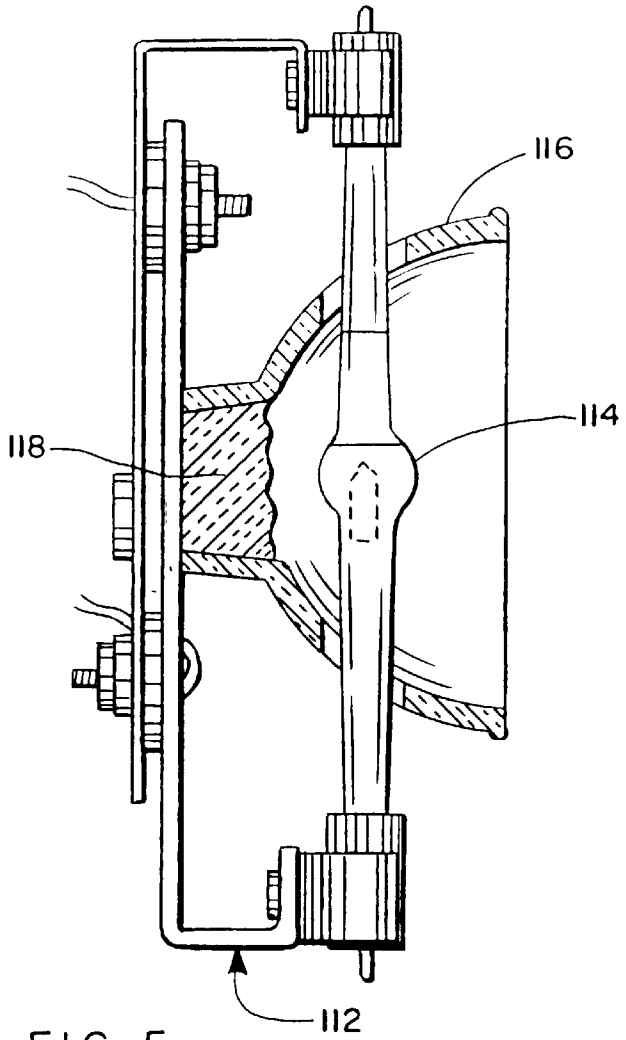
FIG. 5 PRIOR ART
FIG. 5 is a side view illustrating the lamp reflector assembly currently being sold by Dymax Corporation, similar to the embodiment shown in U.S. Pat. No. 5,387,800.

FIG. 5 illustrates the prior-art device currently being sold by Dymax Corporation, which is similar to the embodiment disclosed in U.S. Pat. No. 5,387,800 issued Feb. 7, 1995 to Dymax Corporation of Torrington, Conn. The position of the reflector 116 is movable relative to the lamp 114, and then the reflector 116 is bonded with Saurisen to a thin brass bracket assembly 112 which holds opposing ends of the elongate lamp 114. Saurisen is an insulate cement available from Central Scientific Company. The problems with the Dymax lamp reflector assembly were discussed at length above in the background section of this application.

It is understood that the exemplar mechanically aligned lamp reflector assembly described herein and shown in the drawings represents only a presently preferred embodiment of the invention. Indeed, various modifications and additions may be made to such embodiments without departing from the spirit and scope of the invention. These and other modifications and additions may be obvious to those skilled in the art and may be implemented to adapt the present invention for use in a variety of different applications.

What is claimed is:

1. A lamp reflector assembly comprising:

a base;

a support member having a pair of spaced-apart arms each movably attached to the support member such that the arms are movable forwardly and rearwardly, and each arm having an electrical receptacle thereon, the support member movably attached to the base such that the support member is movable in a plane perpendicular to the forward direction;

an elongate lamp having opposite end portions with electrical contacts thereon, and having a middle portion point source therebetween that emits radiant energy, the lamp contacts releasably attached to the fixture receptacles;

a reflector having a bowl-shaped concave surface with a pair of clearance holes sized to permit the end portions of the lamp to pass therethrough such that the electrical contacts are positioned outside the concave surface, and the middle portion is positioned inside the concave surface such that the radiant energy reflected from the reflector travels in a generally forward direction, the reflector releasably attached to the base; and a plurality of conventional mechanical fasteners for releasably securing the movable arms and support member;

whereby the lamp position is adjustable in at least two dimensions relative the reflector to focus the radiant energy from the reflector, and is readjustable for refocusing at a future date.

2. The lamp reflector assembly of claim 1 wherein the support member is movable only vertically relative the base.

3. The lamp reflector assembly of claim 1 wherein the arms are movable radially about an axis parallel to the elongate lamp.

4. The lamp reflector assembly of claim 1 wherein the support member is made of an insulating material.

5. The lamp reflector assembly of claim 1 wherein the support member is of substantial thickness and nondeformable.

6. The lamp reflector assembly of claim 1 wherein the arms are of substantial thickness and nondeformable.

7. The lamp reflector assembly of claim 1 wherein the reflector is releasably attached to the base at a forward end of the reflector concave surface.

8. A fixture for mechanically focusing radiant energy from a middle portion point source of an elongate lamp positioned inside a bowl-shaped concave surface of a reflector such that the radiant energy travels in a generally forward direction, the lamp having opposing end portions with electrical contacts thereon projecting through a pair of holes in the reflector such that the contacts are positioned outside the concave surface, the fixture comprising:

a base releasably attached to the reflector;

a support member having a pair of spaced-apart arms each movably attached to the support member such that the arms are movable forwardly and rearwardly, and each arm having an electrical receptacle thereon, the support member movably attached to the base such that the support member is movable in a plane perpendicular to the forward direction; and a plurality of conventional mechanical fasteners for releasably securing the movable arms and support member;

whereby the fixture facilitates positioning of the lamp relative the reflector in at least two dimensions to focus the radiant energy from the reflector, and facilitates repositioning and refocusing at a future date.

9. The fixture of claim 8 wherein the support member is movable only vertically relative the base.

10. The fixture of claim 9 wherein the arms are movable radially about an axis parallel to the elongate lamp.

11. The fixture of claim 8 wherein the support member is made of an insulating material.

12. The fixture of claim 8 wherein the support member is of substantial thickness and nondeformable.

13. The fixture of claim 8 wherein the arms are of substantial thickness and nondeformable.

14. The fixture of claim 8 wherein the base is releasably attached to the reflector at a forward end of the reflector concave surface.

15. A method of aligning a lamp inside a reflector to focus output of radiant energy, comprising the steps:

providing a lamp having at least one end portion with an electrical contact thereon and having a middle portion point source that will emit radiant energy;

providing a generally bowl-shaped concave reflector having at least one clearance hole sized to permit the at least one end portion of the lamp to pass therethrough;

releasably attaching the reflector to a base of a fixture;

positioning the middle portion of the lamp inside the reflector such that the radiant energy reflected from the reflector will travel in a generally forward direction;

releasably attaching the at least one end portion of the lamp to a movable arm of the fixture outside the reflector;

moving the arm of the fixture in at least two dimensions to focus the output of radiant energy from the reflector; and releasably securing the movable arm of the fixture, thereby fixing the relative positions of the lamp and reflector, although allowing for repositioning and refocusing at a future date.

16. The method of claim 15 wherein moving the arm of the fixture comprises moving a support member connected to the arm but insulated from the electrical contacts of the lamp.

17. The method of claim 15 wherein releasably attaching the reflector comprises releasably attaching a forward end of the reflector to the base of the fixture.

* * * * *